US005392747A

United States Patent [19]

Nickel et al.

[11] Patent Number: 5,392,747

[45] Date of Patent: Feb. 28, 1995

[54] CIRCUIT FOR SUPPLYING VOLTAGE TO A MICROPROCESSOR IN AN IGNITION CIRCUIT FOR AN INTERNAL COMBUSTION ENGINE

[75] Inventors: Hans Nickel, Cottenweiler; Thomas Schuster, Waiblingen, both of Germany

[73] Assignee: Andreas Stihl, Waiblingen, Germany

[21] Appl. No.: 102,748

[22] Filed: Aug. 6, 1993

[30] Foreign Application Priority Data

Aug. 7, 1992 [DE] Germany ..... 4226100.7

[51] Int. Cl.[6] ..... F02P 3/08; F02P 1/02

[52] U.S. Cl. ..... 123/417; 123/149 D

[58] Field of Search ..... 123/149 D, 417, 480, 123/149 A, 149 R; 323/201

[56] References Cited

U.S. PATENT DOCUMENTS 4,160,435 7/1979 Sleder ..... 123/149 D
4,378,769 4/1983 Haubner et al. ..... 123/416
5,069,193 12/1991 Erhard ..... 123/599
5,161,496 11/1992 Matsushima et al. ..... 123/149 D
5,172,675 12/1992 Kurosu et al. ..... 123/149 A

*Primary Examiner*—Andrew M. Dolinar
*Assistant Examiner*—Thomas N. Moulis
*Attorney, Agent, or Firm*—Walter Ottesen

[57] ABSTRACT

The invention is directed to a circuit for providing a controlled voltage supply to a microprocessor in an ignition circuit of an internal combustion engine equipped with a spark plug. The circuit includes: a generator having an induction coil and magnetic device for generating an alternating voltage in the coil; a microprocessor for controlling the spark plug; the microprocessor having first and second connecting terminals and a capacitor connected across the terminals; a thyristor having a gate electrode is connected between the induction coil and the capacitor; and, a voltage limiter is connected to the gate electrode, The controlled voltage supply for the thyristor is ensured over the entire rpm range of the engine without noticeable energy losses.

10 Claims, 1 Drawing Sheet

CIRCUIT FOR SUPPLYING VOLTAGE TO A MICROPROCESSOR IN AN IGNITION CIRCUIT FOR AN INTERNAL COMBUSTION ENGINE

FIELD OF THE INVENTION

The invention relates to a voltage supply circuit for a microprocessor in an ignition circuit for an internal combustion engine and especially for a two-stroke engine of a portable handheld apparatus such as a motor-driven chain saw, cutoff device and vegetation cutter.

BACKGROUND OF THE INVENTION

U.S. Pat. No. 4,378,769 discloses an ignition circuit for which the supply voltage of a microprocessor is taken off of a capacitor. The capacitor is connected in series with the following: a rectifying diode, a charging resistor limiting the charging current and a charging coil. A voltage is induced in the charging coil by the magnetic field of a rotating magnet wheel. This voltage is dependent upon the rpm of the rotating magnet wheel. The energy content of an induced voltage pulse is low for low rpm and is very high at high rpm. The rpm ranges for two-stroke engines in portable handheld work apparatus lie between 1,000 to 15,000 rpm and in some cases up to 20,000 rpm.

The voltage supply of a microprocessor must be ensured at low rpm as well as at high rpm. Overvoltages can occur at high rpms and a Zener diode is connected in parallel to the capacitor for protection against overvoltages. The avalanche or breakdown voltage of a Zener diode corresponds approximately to the maximum permissible supply voltage. If the supply voltage taken off on the capacitor increases beyond the breakdown voltage at high rpm, then the Zener diode becomes abruptly conductive so that the capacitor is shunted and the overvoltage can decay. At high rpm, an energy pulse is often sufficient to charge the capacitor to the necessary supply voltage for several rotations of the crankshaft. Subsequent energy pulses must therefore be diverted via the Zener diode. A substantial loss of energy occurs which requires a corresponding dimensioning and cooling of the components.

SUMMARY OF THE INVENTION

It is the object of the invention to provide a circuit arrangement of the kind described above which is improved so that a controlled voltage supply for the microprocessor is ensured over the entire rpm range of the internal combustion engine without noticeable energy losses. It is another object of the invention to provide the circuit arrangement with few and simple components.

The circuit of the invention provides a controlled voltage supply to a microprocessor in an ignition circuit of an internal combustion engine equipped with a spark plug. The internal combustion engine can be especially a two-stroke engine in a portable handheld work apparatus such as a motor-driven chain saw, cutoff machine, brushcutter or the like.

The circuit of the invention includes a generator including an induction coil and magnetic means for generating an alternating voltage in the coil; a microprocessor for controlling the spark plug; the microprocessor having first and second connecting terminals; a capacitor connected across the terminals; a thyristor having a gate electrode and being connected between the induction coil and the capacitor; and, voltage limiting means connected to the gate electrode.

The arrangement of the thyristor affords the possibility to permit a current in the charging-current loop which is dependent upon the charging state of the capacitor. The thyristor is blocked for positive as well as for negative halfwaves when the voltage-limiting component determines the proper charging state of the capacitor. Accordingly, no current will flow in the charging-current loop which could lead to a considerable loss of energy when the capacitor is completely charged.

The components are so dimensioned that the charging-current loop only includes the induction coil, the self-quenching thyristor and the capacitor. The short-circuit current is limited because of the ohmic resistance in the induction coil. The short-circuit current charges the capacitor when the thyristor is conductive. The circuit is so tuned that a charging current corresponding to the halfwaves is supplied to the capacitor only until the pregiven charging voltage of the capacitor is reached. The drive of the thyristor can then be accordingly determined from halfwave to halfwave.

According to a feature of the invention, the voltage-limiting component is a comparator having a first comparator input to which the capacitor voltage is applied and a second comparator input to which a reference voltage is applied. If the capacitor voltage lies below the reference voltage, then the potential of the thyristor gate electrode connected to the output of the comparator is adjusted to the ignition voltage of the thyristor. The thyristor then permits a positive halfwave to pass and becomes self-quenching at zero crossover of the current. During the negative halfwave, the comparator again compares whether the charging state of the capacitor is adequate and correspondingly adjusts the potential of the control electrode. If the thyristor blocks, no current flows in the charging-current loop and no energy loss occurs.

In a simplified embodiment of the invention, the voltage-limiting component is a Zener diode having a cathode connected to the gate electrode of the thyristor and having an anode connected to ground. The avalanche or breakdown voltage of the Zener diode corresponds to the maximum permissible supply voltage. The gate electrode of the thyristor is therefore held at this potential by the Zener diode. The cathode voltage of the thyristor corresponds to the voltage on the capacitor. The voltage on the capacitor then decays during discharge thereof and the thyristor becomes conductive as soon as the potential difference between the cathode voltage and the control voltage exceeds a pregiven value so that the capacitor is again charged with the subsequent positive halfwaves of the generator voltage until the capacitor reaches its pregiven charging voltage.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
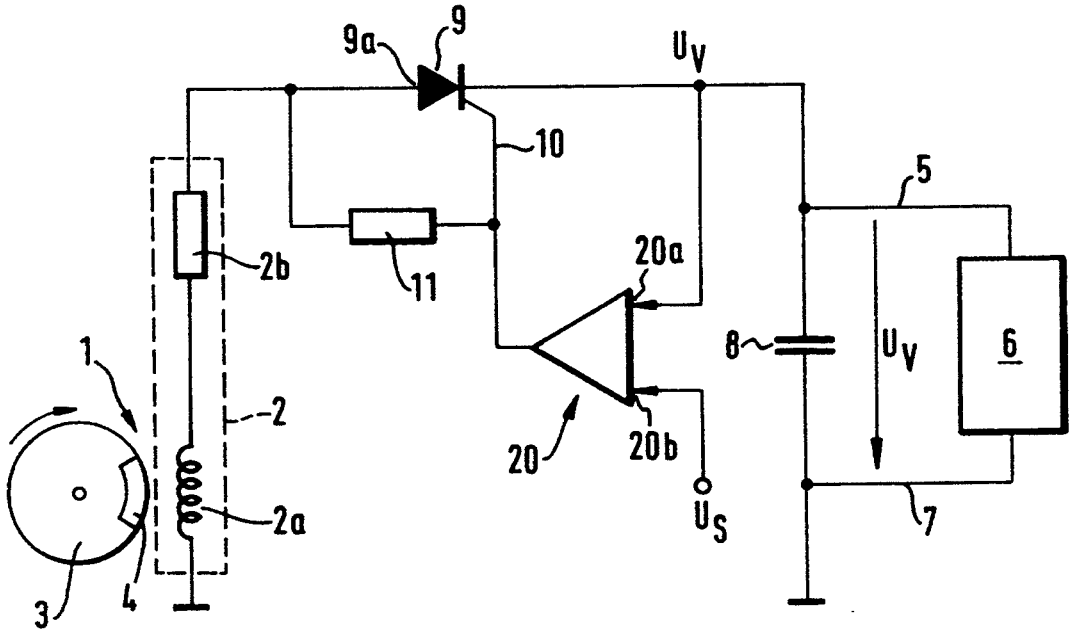
FIG. 1 is a schematic diagram of a circuit according to the invention with this circuit having a comparator; and, FIG. 2 is a schematic of another embodiment of the circuit of the invention with the circuit here having a Zener diode.
Figure 2:
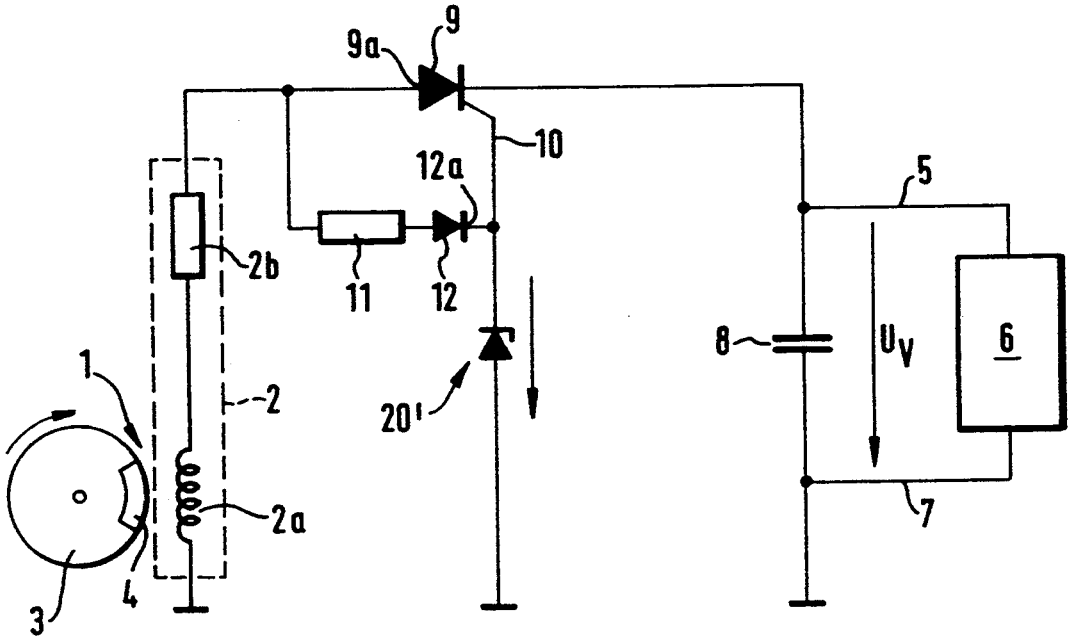

The schematics shown in FIGS. 1 and 2 are for externally-ignited internal combustion engines and especially for two-stroke engines mounted in portable handheld work apparatus such as motor-driven chain saws, cutoff machines, brushcutters and the like.

Referring to FIGS. 1 and 2, the magnetic or capacitive ignition device is supplied by an induction coil 2 fixed to a housing. A magnet wheel 3 having a permanent magnetic peripheral portion 4 is driven by an internal combustion engine and induces a voltage into the induction coil 2 with each revolution of the magnet wheel thereby defining a generator which supplies an alternating voltage dependent upon rpm.

It is, however, also possible to generate the voltage in another way with the magnet not being arranged on the magnet wheel. Instead, the magnet is arranged in an ignition module which is a component of the generator. The generator supplies a spark plug in order to generate an ignition spark. The spark plug is supplied via a switch (not shown) controlled by a microprocessor 6. The induction coil 2 also supplies a capacitor 8. For this purpose, the coil 2 is connected in series with the capacitor 8 via a thyristor 9. The coil 2 is represented in FIGS. 1 and 2 by an equivalent circuit containing inductive reactance 2*a* and ohmic resistance 2*b*. The supply voltage terminals 5 and 7 of the microprocessor 6 are connected to the positive and negative poles, respectively, of the capacitor. The gate electrode 10 of the thyristor 9 is connected via an ohmic resistor 11 to the anode 9*a* of the thyristor.

In the embodiment of FIG. 1, the gate electrode 10 is also connected to the output of a comparator 20 having a first comparator input 20*a* to which is supplied a voltage $U_v$ present on the capacitor 8. A reference voltage $U_{des}$ is applied to the second comparator input 20*b*. The reference voltage $U_{des}$ corresponds to the maximum permissible supply voltage. If the capacitor voltage $U_v$ is less than the reference voltage $U_{des}$, then the comparator 20 switches the thyristor 9 on via the gate electrode 10 so that the thyristor permits the positive halfwave of the next voltage pulse to pass whereby the capacitor 8 is charged and a corresponding increase of the capacitor voltage results.

With the change to the negative halfwave, the self-quenching thyristor 9 blocks and the comparator 20 again compares the capacitor voltage $U_v$ now present to the reference voltage $U_{des}$. The thyristor is repeatedly ignited and each time passes the positive halfwave as long as the ignition voltage $U_v$ is less than the reference voltage $U_{des}$. When the capacitor voltage $U_v$ corresponds to the reference voltage $U_{des}$, no further ignition takes place and the thyristor 9 blocks the positive as well as the negative halfwaves. A next positive halfwave for charging the capacitor 8 is switched through by igniting the thyristor 9 when the capacitor voltage $U_v$ again drops below the reference voltage $U_{des}$.

The components are so dimensioned that the ohmic resistor 2*b* of the induction coil 2 limits the short-circuit current occurring when the thyristor 9 is conductive. The short-circuit current corresponds to the maximum permissible charging current of the capacitor 8. The dimensioning of the components is made so that a positive halfwave cannot lead to an overcharging of the capacitor 8 when the thyristor 9 is conductive. This, in combination with the comparator 20, ensures that a capacitor voltage $U_v$ of low ripple is available as the supply voltage for the microprocessor 6. The thyristor 9 completely blocks the charge-current loop when the capacitor 8 is charged. For this reason, no noticeable energy loss occurs.

Referring to the embodiment of FIG. 2, a Zener diode 20' is provided as a voltage-limiting component. A series circuit, which includes the resistor 11 and a diode 12, and the Zener diode 20' operated in the blocking direction conjointly define a voltage divider. The gate electrode 10 of the thyristor 9 is connected to the circuit node between the cathode 12*a* of the diode 12 and the Zener diode 20'.

The breakdown voltage of the Zener diode 20' corresponds to the maximum permissible supply voltage $U_v$. The gate electrode 10 is therefore held at constant potential by the Zener diode 20'. This constant potential corresponds to the maximum permissible supply voltage $U_v$.

The circuit is so dimensioned that the thyristor 9 is blocked as long as the potential difference between the cathode and the gate electrode 10 does not exceed a pregiven value which, in the embodiment shown, is 0.8 V. When the capacitor 8 then discharges and the anode voltage of the thyristor 9 drops to the extent that the potential difference to the gate electrode 10 becomes greater than the pregiven value of 0.8 V, the thyristor 9 becomes conductive in the forward direction and a charging current flows into the capacitor 8 with the next positive halfwave of the generator. The thyristor 9 is again extinguished when the generator alternating voltage passes through zero but is again, however, ignited as long as the potential difference between the cathode voltage and the gate voltage has not dropped to a value below 0.8 V.

The condition is obtained with the ignition circuit of FIG. 2 in the same manner as FIG. 1 that the supply voltage $U_v$ has a lower ripple and it is likewise ensured that no noticeable energy losses occur because of the blocked thyristor 9 when the capacitor 8 is charged.

It is understood that the foregoing description is that of the preferred embodiments of the invention and that various changes and modifications may be made thereto without departing from the spirit and scope of the invention as defined in the appended claims.

What is claimed is:

1. A circuit for providing a controlled voltage supply to a microprocessor in an ignition circuit of an internal combustion engine equipped with a spark plug, the circuit comprising:

a generator including an induction coil and magnetic means for generating an alternating voltage in said coil;

a microprocessor for controlling said spark plug;

said microprocessor having first and second connecting terminals;

a capacitor connected across said terminals;

a thyristor having a gate electrode and being connected between said induction coil and said capacitor; and, voltage limiting means connected to said gate electrode.

2. The circuit of claim 1, said induction coil being fixedly mounted and said magnetic means comprising: a magnet wheel driven by said engine and having a periphery; and, said magnet wheel having permanent magnet means defining a portion of said periphery and said permanent magnet means providing a magnetic field for generating said alternating voltage in said induction coil as said magnet wheel rotates.

3. The circuit of claim 2, only said induction coil, said thyristor and said capacitor conjointly defining a charging-current loop.

4. The circuit of claim 1, said capacitor receiving a capacitor voltage $U_v$ during the operation of said circuit; and, said voltage limiting means comprising a comparator having first and second inputs; said first input being connected to said capacitor thereby applying said capacitor voltage $U_v$ to said first input; and, reference voltage supply means for applying a reference voltage $U_{des}$ to said second input.

5. The circuit of claim 1, said voltage limiting means comprising: a Zener diode having an anode and having a cathode connected to said gate electrode; a resistor connected between said generator and said cathode; said anode of said Zener diode being connected to ground; and, said Zener diode having a breakdown voltage corresponding to the maximum possible supply voltage which can be supplied to said microprocessor via said capacitor.

6. The circuit of claim 5, said voltage limiting means further comprising a series diode connected in series with said resistor; and, said series diode having a cathode connected to said gate electrode.

7. The circuit of claim 5, said thyristor having an anode and said resistor having one end connected to said anode of said thyristor.

8. The circuit of claim 5, said capacitor receiving a capacitor voltage $U_v$ during operation of the circuit; said thyristor having a cathode connected directly to said capacitor thereby causing said cathode to be at a cathode voltage corresponding to said capacitor voltage $U_v$; said voltage limit means causing a control voltage to be applied to said gate electrode which is held constant by said Zener diode; and, said thyristor becoming conductive when the difference between said cathode voltage and said control voltage exceeds a pregiven value.

9. The circuit of claim 8, said pregiven value being 0.8 volt.

10. The circuit of claim 1, said thyristor having an anode and said voltage limiting means comprising a resistor connected across said anode and said gate electrode.

* * * * *